US010633065B2

(12) United States Patent
Chiu

(10) Patent No.: US 10,633,065 B2
(45) Date of Patent: Apr. 28, 2020

(54) FLOATATION DEVICE

(71) Applicant: Otteroo Corporation, San Francisco, CA (US)

(72) Inventor: Tiffany An-Ting Chiu, San Francisco, CA (US)

( * ) Notice: Subject to any disclaimer, the term of this patent is extended or adjusted under 35 U.S.C. 154(b) by 0 days.

(21) Appl. No.: 15/806,250

(22) Filed: Nov. 7, 2017

(65) Prior Publication Data

US 2018/0127072 A1 May 10, 2018

Related U.S. Application Data

(60) Provisional application No. 62/418,682, filed on Nov. 7, 2016.

(51) Int. Cl.

| | |
|---|---|
| ***B63C 9/15*** | (2006.01) |
| ***A63B 31/00*** | (2006.01) |
| *A63B 71/00* | (2006.01) |

(52) U.S. Cl.

CPC ..... *B63C 9/155* (2013.01); *A63B 31/00* (2013.01); *A63B 71/0054* (2013.01); *A63B 2208/029* (2013.01); *A63B 2208/0233* (2013.01); *A63B 2208/12* (2013.01); *A63B 2209/10* (2013.01); *A63B 2210/50* (2013.01); *A63B 2225/09* (2013.01); *A63B 2225/605* (2013.01); *A63B 2225/62* (2013.01)

(58) Field of Classification Search

CPC ..... B63C 9/155; A63B 31/00; A63B 2208/12
See application file for complete search history.

(56) References Cited

U.S. PATENT DOCUMENTS

| | | | | | |
|---|---|---|---|---|---|
| 1,043,367 | A | * | 11/1912 | Smack | B63C 9/155 441/123 |
| 4,687,452 | A | * | 8/1987 | Hull | A47C 4/54 114/345 |
| 5,334,067 | A | | 8/1994 | Henry | |
| 5,421,760 | A | * | 6/1995 | Blaga | B63C 9/155 441/123 |
| 5,570,480 | A | * | 11/1996 | Yeung | A47C 15/006 114/346 |

(Continued)

FOREIGN PATENT DOCUMENTS

| | | | | |
|---|---|---|---|---|
| CN | 2008-007174 | * | 7/2008 | B63C 9/155 |

OTHER PUBLICATIONS

International Search Report and Written Opinion dated Jan. 17, 2018 in International Patent Application No. PCT/US2017/060471.

*Primary Examiner* — S. Joseph Morano
*Assistant Examiner* — Jovon E Hayes
(74) *Attorney, Agent, or Firm* — Byrne Poh LLP

(57) ABSTRACT

A floatation device is provided. In some embodiments, a floatation device is provided, comprising an inflatable ring composed of a transparent material, wherein the inflatable ring includes: an outer air chamber having a first valve for inflating the outer air chamber; an inner air chamber having a second valve for inflating the inner air chamber, wherein the outer air chamber and the inner air chamber are not in communication; a cut through the outer air chamber and the inner air chamber of the inflatable ring that forms opposing ends of the inflatable ring; and a plurality of fasteners placed on a top surface and a bottom surface of the outer or inner air chamber for detachably connecting the opposing ends of the inflatable ring.

13 Claims, 5 Drawing Sheets

(56) References Cited

U.S. PATENT DOCUMENTS

| | | | | | |
|---|---|---|---|---|---|
| 5,779,512 | A * | 7/1998 | Rupert | B63C 9/13 | 441/123 |
| 6,164,237 | A * | 12/2000 | Coryell | B63B 7/08 | 114/345 |
| 6,223,673 | B1 * | 5/2001 | Mears | A63B 5/11 | 114/264 |
| 6,345,744 | B1 * | 2/2002 | Eldridge | A01M 31/00 | 220/560 |
| 6,948,991 | B2 * | 9/2005 | Zhao | B63C 9/155 | 441/123 |
| 7,314,399 | B2 * | 1/2008 | Turner | A47C 15/006 | 441/129 |
| D624,250 | S * | 9/2010 | Hamilton | B63B 35/73 | D30/152 |
| 8,187,047 | B1 * | 5/2012 | Brooks | B63B 35/76 | 114/345 |
| 8,523,621 | B2 * | 9/2013 | Whitman | B63B 35/73 | 114/345 |
| 9,248,888 | B2 * | 2/2016 | Chiu | B63C 9/155 | |
| 2011/0201479 | A1 | 8/2011 | Higgs | | |
| 2013/0267135 | A1 * | 10/2013 | Berenson | B63B 35/78 | 441/132 |
| 2014/0179183 | A1 * | 6/2014 | Chiu | B63B 35/76 | 441/129 |
| 2017/0113156 | A1 * | 4/2017 | White | A63H 23/10 | |

* cited by examiner

FLOATATION DEVICE

CROSS-REFERENCE TO RELATED APPLICATIONS

This application claims the benefit of U.S. Provisional Patent Application No. 62/418,682, filed Nov. 7, 2016, which is hereby incorporated by reference herein in its entirety.

TECHNICAL FIELD

In accordance with various embodiments of the disclosed subject matter, a flotation device is provided. More particularly, the disclosed subject matter relates to a swim ring for a wearer such that the wearer can exercise in a body of water, such as a pool.

BACKGROUND

A swim ring is generally a donut-shaped inflatable tube that is made of a flexible plastic material. To achieve this shape, the swim ring generally includes two identically-sized circular layers of plastic, where an inner concentric circle of plastic has been removed and where the inner and outer edges are joined to form an air chamber. The swim ring also includes a valve that allows the air chamber of the swim ring to be inflated with air. Once inflated, the swim ring can, for example, be placed around the torso of the user. For infants, swim rings are made that can be placed around the neck of an infant.

SUMMARY

In accordance with various embodiments of the disclosed subject matter, a floatation device is provided.

In accordance with some embodiments of the disclosed subject matter, a floatation device for a wearer is provided, the floatation device comprising: an inflatable ring composed of a transparent material, wherein the inflatable ring includes: an outer air chamber having a first valve for inflating the outer air chamber; an inner air chamber having a second valve for inflating the inner air chamber, wherein the outer air chamber and the inner air chamber are not in communication; a cut through the outer air chamber and the inner air chamber of the inflatable ring that forms opposing ends of the inflatable ring; and a plurality of fasteners placed on a top surface and a bottom surface of the outer air chamber for detachably connecting the opposing ends of the inflatable ring.

In some embodiments, the first valve is formed on the top surface of the outer air chamber. In some embodiments, the first valve is formed on the bottom surface of the outer air chamber.

In some embodiments, the second valve is formed on the top surface of the inner air chamber. In some embodiments, the second valve is formed on the bottom surface of the inner air chamber.

In some embodiments, upon independently inflating the outer air chamber via the first air valve and the inner air chamber via the second air valve and connecting the plurality of fasteners to connect the end and the opposing end of the inflatable ring, the inflatable ring is substantially toroid-shaped.

In some embodiments, the floatation device further comprises a recess for a chin rest that is formed in the inner air chamber.

In accordance with some embodiments of the disclosed subject matter, a method for providing a floatation device for an infant is provided, the method comprising: providing an inflatable ring composed of a transparent material, wherein the inflatable ring includes: an outer air chamber having a first valve for inflating the outer air chamber; an inner air chamber having a second valve for inflating the inner air chamber, wherein the outer air chamber and the inner air chamber are not in communication; a cut through the outer air chamber and the inner air chamber of the inflatable ring that forms opposing ends of the inflatable ring; and a plurality of fasteners placed on a top surface and a bottom surface of the outer air chamber for detachably connecting the opposing ends of the inflatable ring; inflating the outer air chamber via the first valve; and inflating the inner air chamber via the second valve.

In some embodiments, the inner air chamber is inflated via the second valve prior to inflating the outer air chamber via the first valve.

In some embodiments, the method further comprises placing a neck of the infant into an interior space formed in a center region of the inflatable ring in which the outer air chamber and the inner chamber have been independently inflated.

In some embodiments, the method further comprises placing an object of interest proximal to the infant wearing the inflatable ring, wherein the transparent material of the inflatable ring allows the object of interest to be visible in a line of sight of the infant.

In some embodiments, the method further comprises attaching the plurality of fasteners to connect the opposing ends of the inflatable ring.

In some embodiments, the method further comprises placing a chin of the infant onto a recess that is formed on the inner air chamber.

In accordance with some embodiments of the disclosed subject matter, a floatation device for a wearer is provided, the floatation device comprising: an inflatable ring composed of a transparent material that has a top surface, a bottom surface, and an interior space, wherein the inflatable ring includes: a toroid-shaped outer air chamber having a first valve for inflating the toroid-shaped outer air chamber; a toroid-shaped inner air chamber having a second valve for inflating the inner air chamber, wherein the toroid-shaped outer air chamber and the toroid-shaped inner air chamber are not in communication and wherein the toroid-shaped inner air chamber is formed such that an outer edge of the toroid-shaped inner air chamber is connected to an inner edge of the toroid-shaped outer air chamber; a cut through the toroid-shaped outer air chamber and the toroid-shaped inner air chamber of the inflatable ring that forms opposing ends of the inflatable ring; and a plurality of fasteners placed on a top surface and a bottom surface of the toroid-shaped outer air chamber for detachably connecting the opposing ends of the inflatable ring.

BRIEF DESCRIPTION OF THE DRAWINGS

Various objects, features, and advantages of the disclosed subject matter can be more fully appreciated with reference to the following detailed description of the invention when considered in connection with the following drawing, in which like reference numerals identify like elements.

DETAILED DESCRIPTION

Figure 1:
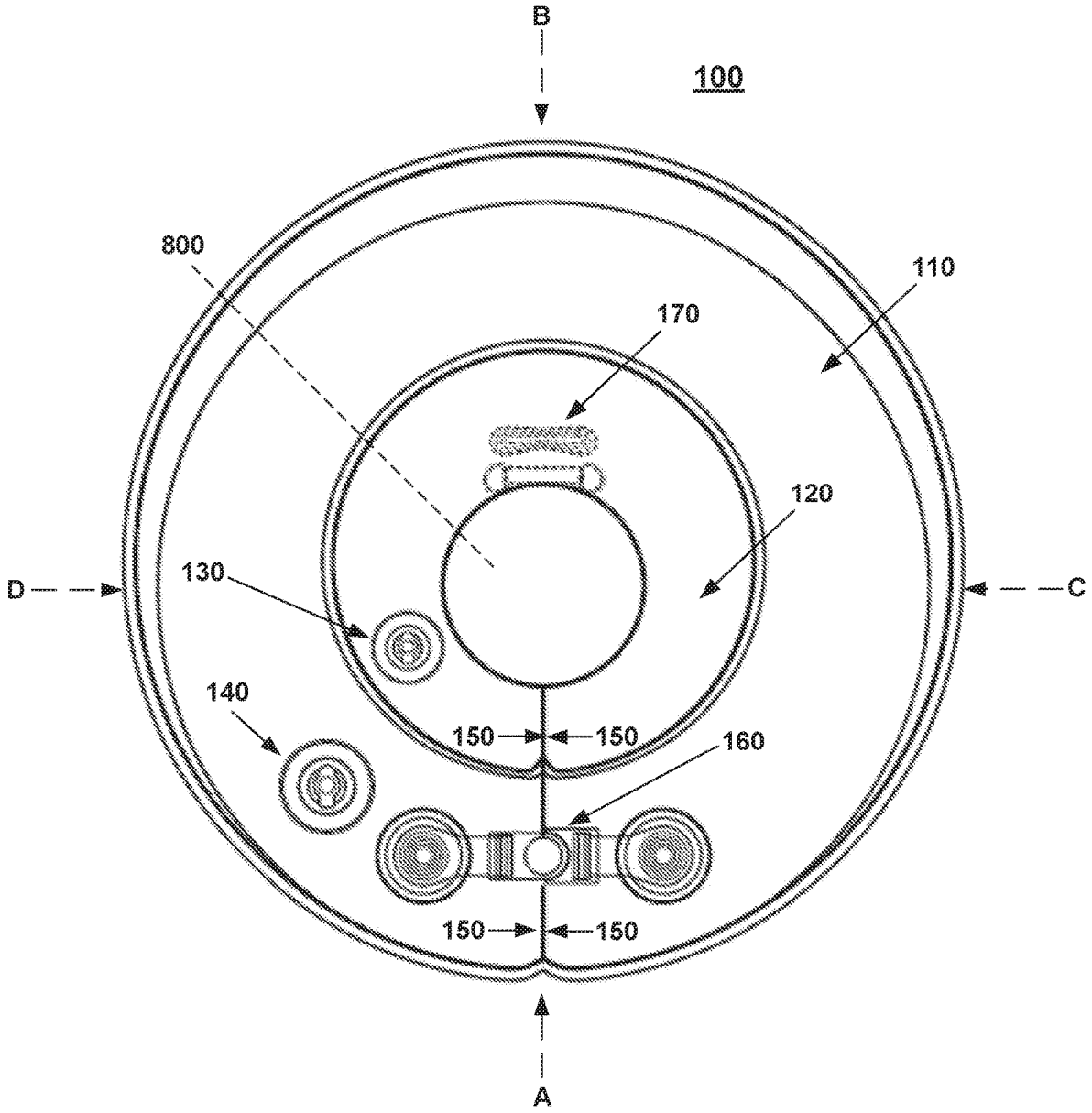
FIG. 1 is an illustrative example of a top plan view of a floatation device, where the outer air chamber and the inner air chamber have been independently inflated with air, in accordance with some embodiments of the disclosed subject matter.

In accordance with various embodiments of the disclosed subject matter, a floatation device is provided.

Generally speaking, the floatation device includes an inflatable ring. The inflatable ring can include an outer air chamber that is inflated via a corresponding air valve and an inner air chamber that is inflated via a corresponding air valve. The outer air chamber and the inner air chamber can be constructed and/or cut such that opposing ends of the inflatable ring are formed. When inflated, the outer air chamber and the inner air chamber form a central opening, where the neck of the wearer can be placed when using the floatation device.

It should be noted that the outer air chamber and the inner air chamber are independently inflated via their respective air valves. Accordingly, the outer air chamber and the inner air chamber of the inflatable ring are not in communication.

It should also be noted that, in some embodiments, the inflatable ring and, more particularly, the outer air chamber and the inner air chamber are composed of a transparent material. As such, in using the floatation device composed of the transparent material where the outer air chamber and the inner air chamber are independently inflated via their respective air valves, where the neck of the wearer is placed within the central opening, and where the wearer wearing the floatation device is placed in a body of water, objects of potential interest (e.g., floating toys) that are positioned near and in front of the wearer can be unobstructed from the view of the wearer. It should be noted that the wearer can be, for example, an infant, a toddler, or an adult having a disability or otherwise wearer in need of physical therapy. For example, a caregiver or therapist accompanying an infant wearing the floatation device and that has been placed in the body of water can also be provided with an unobstructed view of, among other things, the movements of the infant (e.g., the body position of the infant). In another example, a wearer of the floatation device can be assisted by a therapist, where such aquatic or physical therapy can leverage the buoyancy of water to help overcome gravitational constraints, such as the constraints gravity imposes on control of movement for infants who are not ambulant on land or who have a limited range of mobility due to muscular or neuromuscular disabilities or temporary developmental delays.

It should further be noted that, when the outer air chamber and the inner air chamber are independently inflated via their respective air valves, the inflatable ring can be substantially annular-shaped, ring-shaped, donut-shaped, or toroid-shaped. In some embodiments, one or more fasteners can be provided to removably connect the opposing ends of the inflatable ring. This can, for example, allow the inflatable ring to further achieve an annular or toroid shape.

These and other features of the floatation device are further described in connection with FIGS. 1-7.

It should be noted that the floatation device can be used in a variety of applications. For example, the floatation device can be placed around the neck of an infant to allow the infant to move his or her arms and legs in an unrestricted manner in a body of water (e.g., a swimming pool). In this example, an infant can use the floatation device to learn to swim or perform swimming motions in a swimming pool prior to being able to walk or crawl. Moreover, the floatation device can be used to allow the infant to exercise and, more particularly, to perform physical therapy exercises (e.g., when the infant does not yet possess adequate neck strength and/or head control for performing such exercises). In continuing this example, the floatation device being composed of a transparent material can be used for aquatic therapy where objects can be placed in front of infants wearing the floatation device, thereby being used to improve muscle tone, increase core strength, enhance circulation, improve cardiovascular functioning, improve flexibility, increase endurance, extend range of motion, reduce muscle spasticity, and/or relieve joint stress.

It should also be noted that, although the embodiments described herein may refer to the use of the floatation device with infants, the floatation device can be used with any suitable wearer. For example, an adult needing physical therapy can use the floatation device, where the transparent material can allow the adult wearing the floatation device to see objects placed in front of the adult while in the body of water and can allow the therapist assisting the adult to observe the motions of the adult while wearing the floatation device.

Turning to FIG. 1, a floatation device 100 in accordance with various embodiments of the disclosed subject matter is shown. As shown in FIG. 1, floatation device 100 can include an outer air chamber 110 and an inner air chamber 120. Outer air chamber 110 can be inflated with air or any other suitable gas using a first valve 140 and inner air chamber 120 can be inflated with air or any other suitable gas using a second valve 130. Valves 130 and 140 can be any suitable valve that allows a user, such as a caregiver or a therapist, to inflate or deflate floatation device 100.

In some embodiments, at least two layers of ring-shaped pieces of plastic having the appropriate thickness and having the appropriate portions removed can be joined together to create outer air chamber 110 and inner air chamber 120. For example, the layers of plastic can be joined together at their outer and inner edges (e.g., the outer edge of inner air chamber 120 to the inside edge of outer air chamber 110) using a high frequency plastic welding machine.

Figure 8:
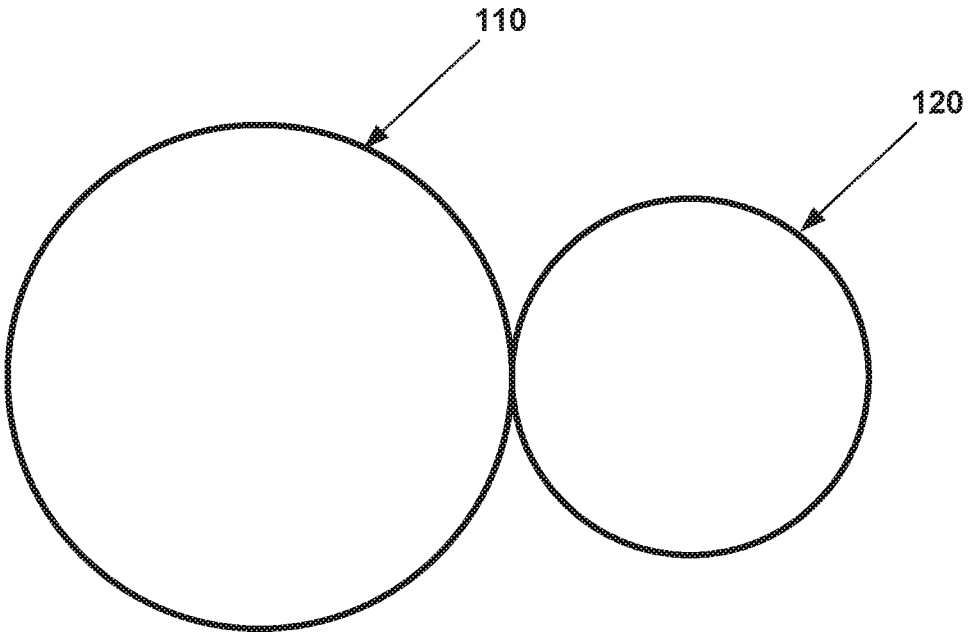
FIG. 8 shows an illustrative example of a cross-section of the flotation device shown in FIG. 1 along a line 800 in accordance with some embodiments of the disclosed subject matter.

An illustrative example of a cross-section of flotation device 100 along line 800 is shown in FIG. 8. As shown in FIG. 8, outer air chamber 110 can be adjacent to inner air chamber 120, where the outer edge of inner air chamber 120 is connected to the interior edge of outer air chamber 110. As also shown in FIG. 8, the diameter of outer air chamber 110 can be larger than the diameter of inner air chamber 120.

It should be noted that outer air chamber 110 and inner air chamber 120 are independently inflated via their respective air valves. For example, as shown in FIG. 1, valve 140 can be formed in floatation device 100 for inflating or deflating outer air chamber 110. Similarly, as also shown in FIG. 1, valve 130 can be formed in floatation device 100 for inflating or deflating inner air chamber 120. Thus, outer air chamber 110 and inner air chamber 120 of floatation device 100 are not in fluid communication. By constructing outer air chamber 110 and inner air chamber 120 such that they are not in fluid communication, buoyancy of floatation device 100 can be maintained in response to air leaking out of either outer air chamber 110 or inner air chamber 120. This can, for example, create a safety mechanism in the event where air leaks out of either outer air chamber 110 or inner air chamber 120.

In a more particular example, outer air chamber 110 can be inflated using first valve 140 and inner air chamber 120 may not yet be inflated using second valve 130. Alternatively, inner air chamber 120 can be inflated using second valve 130 and outer air chamber 110 may not yet be inflated using first valve 140.

It should also be noted that, although only one valve is shown in FIG. 1 for each air chamber (e.g., valve 130 corresponding to inner air chamber 120 and valve 140 corresponding to outer air chamber 110), this is merely illustrative. Any suitable number of valves for inflating and/or deflating the floatation device can be provided. In one suitable embodiment, multiple valves connected to outer air chamber 110 can be placed on the top surface of floatation device 100 and multiple valves connected to inner air chamber 120 can be placed on the top surface of floatation device 110. Alternatively, any suitable combination of valves connected to outer air chamber 110 or inner air chamber 120 can be placed on the top and bottom surfaces of floatation device 100—e.g., two valves for inflating outer air chamber 110 with one positioned on the top surface and one positioned on the bottom surface and one valve for inflating inner air chamber 120 that is positioned on the top surface.

Note that, while multiple valves can be provided (e.g., on the top and bottom surfaces of floatation device 100), a sheet or layer may not be used to separate outer air chamber 110 or inner air chamber 120 into multiple air chambers (e.g., upper chambers and lower chambers) unlike other floatation devices. As such, only one valve (e.g., valve 140) may be needed for inflating or deflating outer air chamber 110 and only one valve (e.g., valve 130) may be needed for inflating or deflating inner air chamber 120. Such a valve can be formed on the top surface or the bottom surface of floatation device 100.

It should further be noted that any suitable type of valve can be used for valve 130 or valve 140. For example, in some embodiments, valve 130 and/or valve 140 can be a one-way valve that allows the intake of air or any other suitable gas, but inhibits the expulsion of air or any other suitable gas from air chamber 110 or 120, respectively, until purposefully released (e.g., using a release mechanism for releasing air from chamber 110 or 120). This can, for example, inhibit the release of air from outer air chamber 110 via valve 140 or from inner air chamber 120 via valve 130. In another example, in some embodiments, valve 130 and/or valve 140 can require a particular type of pump for either outer air chamber 110 or inner air chamber 120 to be inflated.

In some embodiments, opposing ends 150 of floatation device 100 can be formed by a cut made through outer air chamber 110 and inner air chamber 120. As shown in FIG. 1, a cut can be made through both outer air chamber 110 and inner air chamber 120. Alternatively, in some embodiments, a cut can be made through outer air chamber 110 and inner air chamber 120 can have a partial toroid-shaped such that a cut is not needed to create opposing ends 150 for inner air chamber 120.

Figure 3:
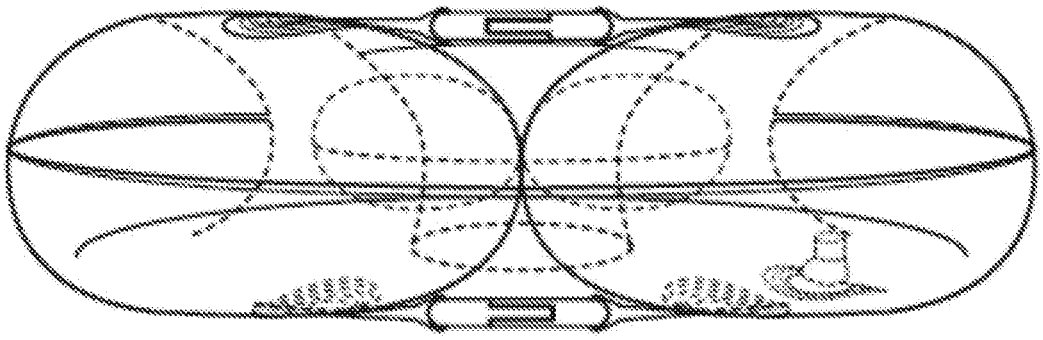
FIG. 3 is an illustrative example of an alternative side view of the flotation device shown in FIG. 1 from direction A in accordance with some embodiments of the disclosed subject matter.

In some embodiments, upon inflating outer air chamber 110 and inner air chamber 120 with air and upon placing the neck of a wearer into a central opening of floatation device 100, opposing ends 150 of floatation device 100 can be connected using one or more fasteners 160. For example, as shown in FIG. 3, fastener 160 can be provided on the top surface of outer air chamber 110 and fastener 160 can be provided on the bottom surface of outer air chamber 110.

It should be noted that, although the embodiments described herein generally show fastener 160 on the top surface of outer air chamber 110 and fastener 160 on the bottom surface of outer air chamber 110 that can detachably connect opposing ends 150, this is merely illustrative. Any suitable number of fasteners can be provided. For example, only one set of fasteners 160 can be provided on the top surface of outer air chamber 110. In another example, fasteners 160 can be provided on the top surface of inner air chamber 120. In yet another example, one set of fasteners 160 can be provided on the top surface of outer air chamber 110 and another set of fasteners 160 can be provided on the top surface of inner air chamber 120.

It should also be noted that any suitable type of fastener can be used. For example, as shown in FIG. 1, fastener 160 includes a snap buckle that can be fastened to connect opposing ends 150. In another example, fastener 160 can be a fabric hook and loop fastener that adhesively connects opposing ends 150.

It should be further noted that, when using fastener 160 to connect opposing ends 150, opposing ends 150 can be substantially flat. By providing opposing ends 160 that are substantially flat, floatation device 100 can be substantially annular, donut, ring, or toroid in shape.

In some embodiments, a chin rest 170 can be formed on inner air chamber 120. For example, as shown in FIG. 1, chin rest 170 can be formed on the center portion of inner air chamber 120. Alternatively, chin rest 170 can be formed on any other suitable portion of floatation device 100, such as a portion of inner air chamber 120. This can, for example, align the placement of the wearer in the floatation device.

Additional views of floatation device 110 are shown in FIGS. 2-7.

Figure 2:
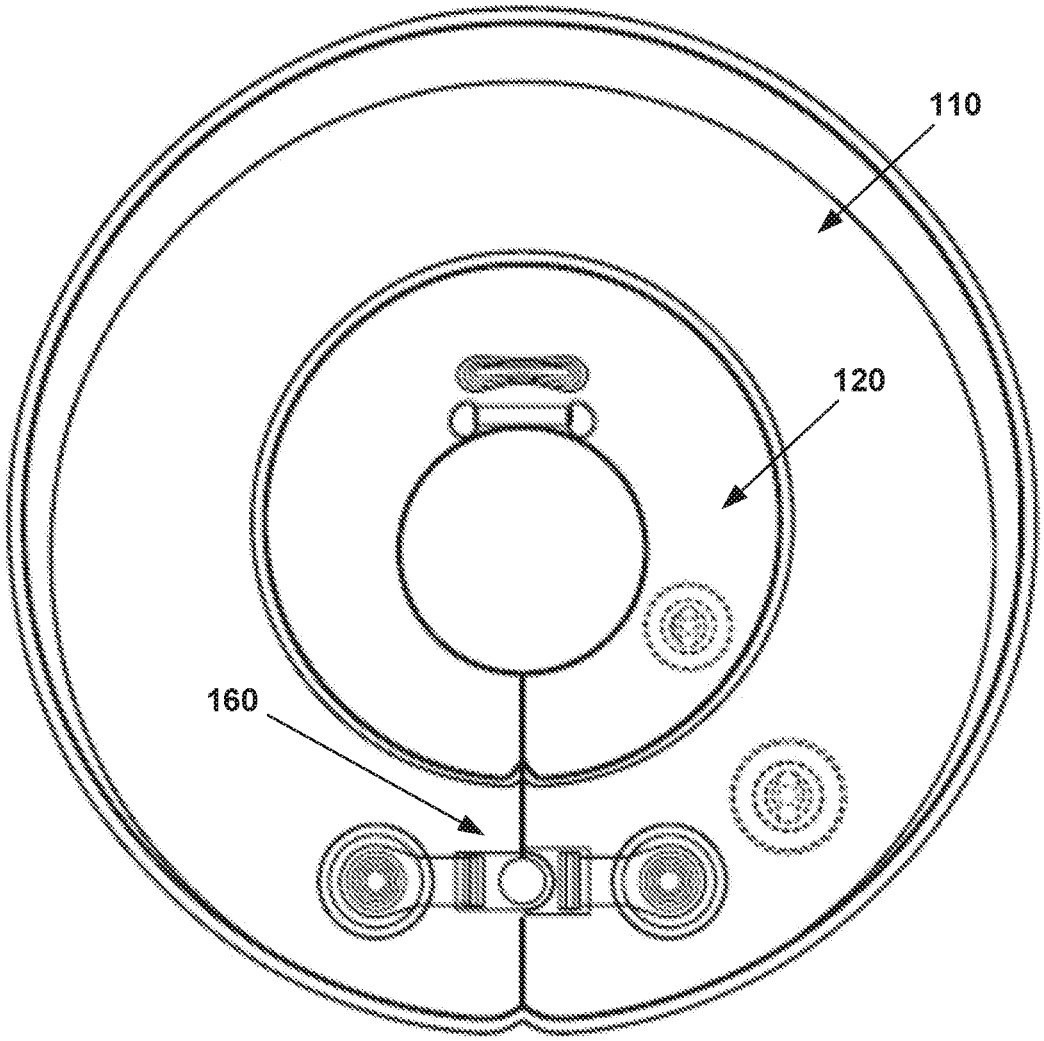
FIG. 2 is an illustrative example of a bottom plan view of the flotation device shown in FIG. 1 in accordance with some embodiments of the disclosed subject matter.
Figure 7:
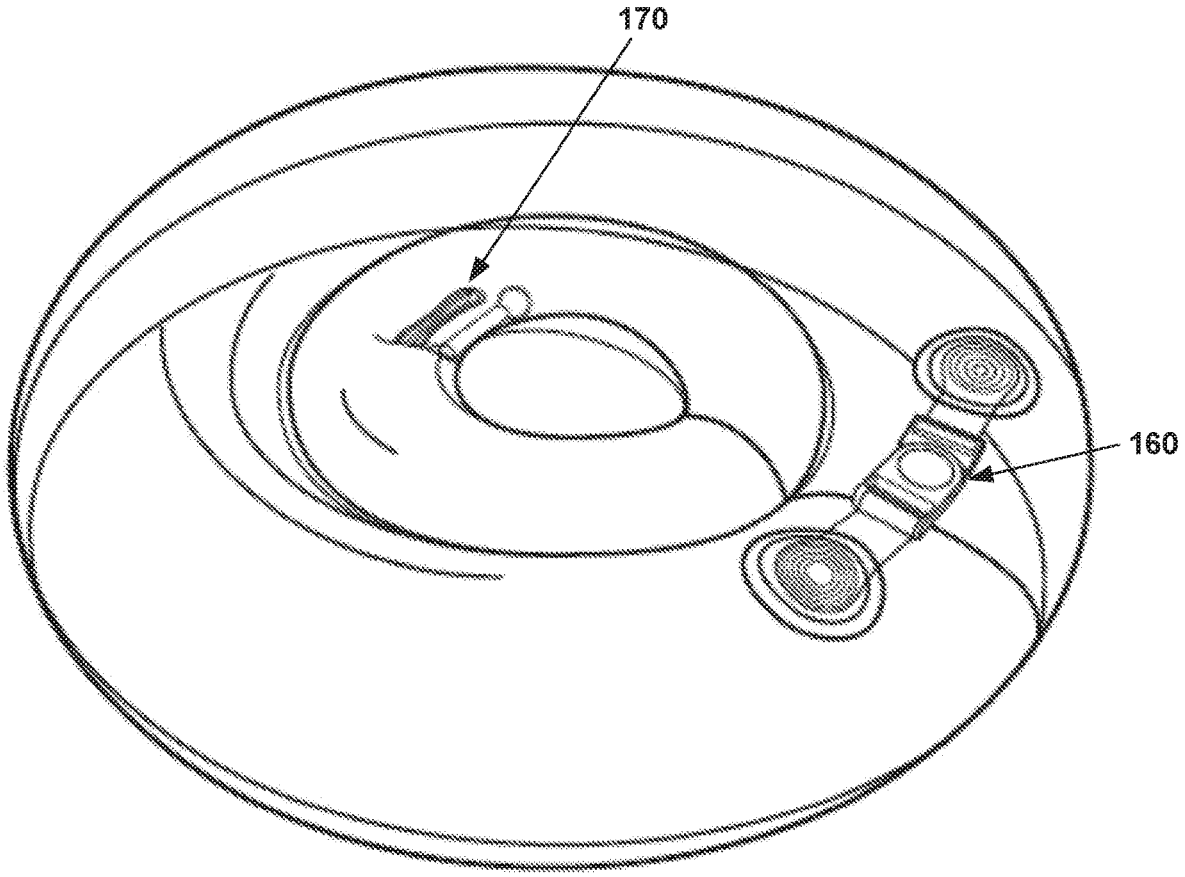
FIG. 7 is an illustrative example of a perspective view of the flotation device shown in FIG. 1 in accordance with some embodiments of the disclosed subject matter.

For example, FIG. 2 shows an illustrative example of a bottom view of flotation device 100. It should be noted that, in some embodiments, the valves (e.g., valves 140 and 130) can be positioned on the bottom of outer air chamber 110 and inner air chamber 120 such that the top view of flotation device 100 includes chin rest 170 and fastener 160. For example, FIG. 7 shows a perspective view of flotation device 100 in which the top surface of flotation device 100 includes fastener 160 and chin rest 170.

Figure 4:
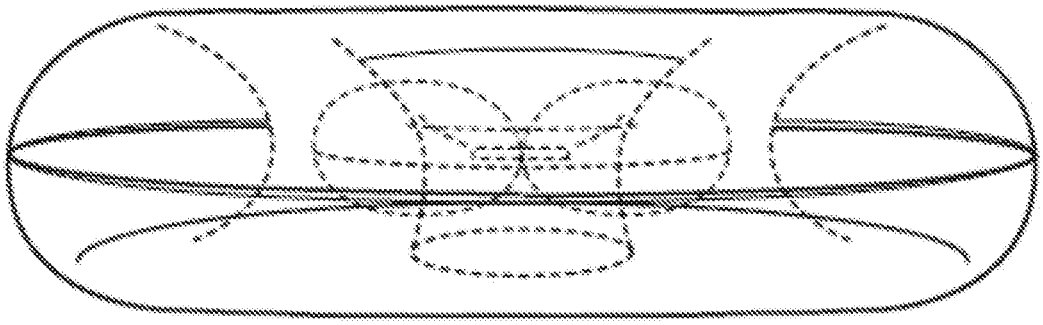
FIG. 4 is an illustrative example of an alternative side view of the flotation device shown in FIG. 1 from direction B in accordance with some embodiments of the disclosed subject matter.
Figure 5:
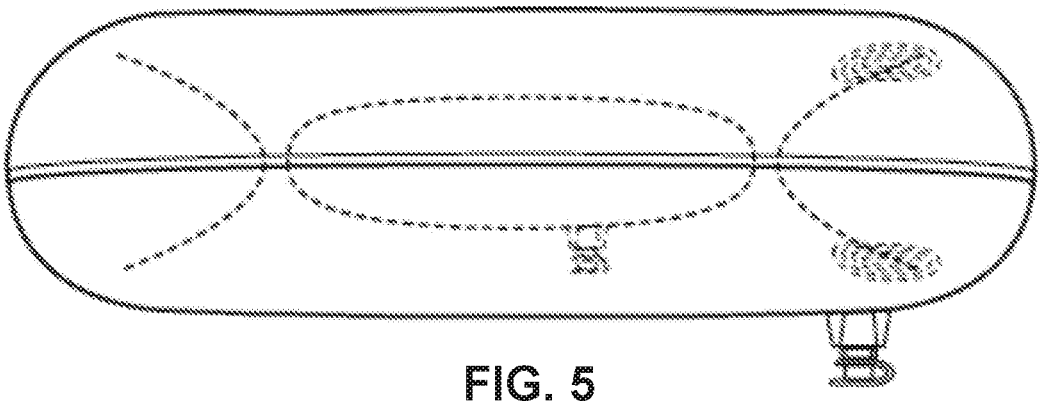
FIG. 5 is an illustrative example of an alternative side view of the flotation device shown in FIG. 1 from direction C in accordance with some embodiments of the disclosed subject matter.
Figure 6:
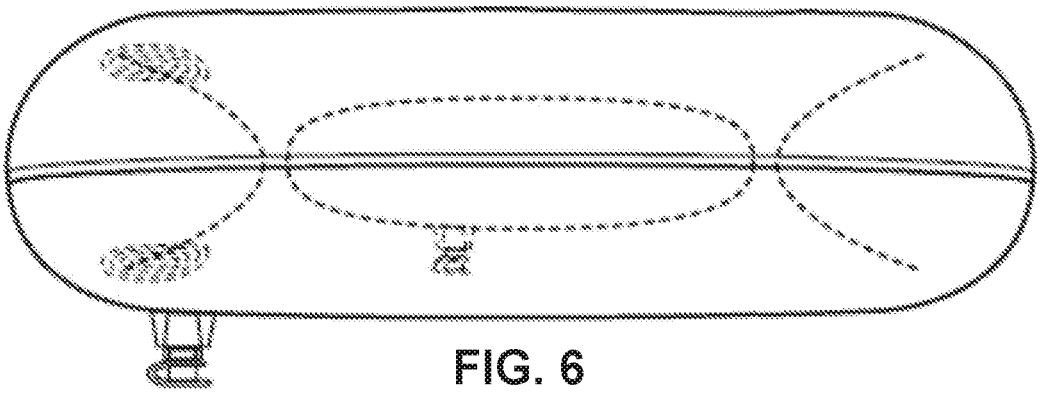
FIG. 6 is an illustrative example of an alternative side view of the flotation device shown in FIG. 1 from direction D in accordance with some embodiments of the disclosed subject matter.

Turning to FIGS. 3-6, additional views of flotation device 100 are shown. For example, FIG. 3 shows an illustrative example of a view of flotation device 100 from direction A shown in FIG. 1, while FIG. 4 shows an illustrative example of a view of flotation device 100 from opposing direction B shown in FIG. 1. In another example, FIG. 5 shows an illustrative example of a view of flotation device 100 from direction C shown in FIG. 1, while FIG. 6 shows an illustrative example of a view of flotation device 100 from opposing direction D shown in FIG. 1.

In some embodiments, floatation device 100 can include one or more toys. For example, multiple colored balls can be placed within outer air chamber 110 and/or inner air chamber 120. These colored balls can move within outer air chamber 110 or inner air chamber 120, for example, as an infant using floatation device 100 moves around in a body of water.

In some embodiments, floatation device 100 can include one or more handles. For example, handles can be placed on the top surface of outer air chamber 110 and/or inner air chamber 120. More particularly, in some embodiments, two handles can be placed on the top surface of outer air chamber 110, where one handle is positioned on the left side of floatation device 100 and another handle is positioned on the right side of floatation device 100.

It should be noted that, although the embodiments described herein generally show a top surface of the floatation device that includes handles, a chin rest, and multiple toys within one or more of outer air chamber 110 and inner air chamber 120 of the floatation device, this is merely illustrative. In some embodiments, the floatation device can be turned on its opposing side, where the opposing side includes similar or different features—e.g., two handles for controlling the floatation device, a chin rest in an alternative position, different toys within the chamber of the floatation device, etc.

In some embodiments, floatation device 100 can include a detachable seat system. For example, the detachable seat system can include a pair of leg holes in which a wearer can insert his or her legs and a seat can be attached to floatation device 100 so that the wearer is not in danger of falling through floatation device 100.

In some embodiments, floatation device 100 can include a detachable tether. One end of the detachable tether can be connected to the wrist of a caregiver. The other end of the detachable tether can be attached to any suitable portion of floatation device 100. For example, the detachable tether can be connected to one of the handles on the top surface of outer air chamber 110. In another example, the detachable tether can be connected to the detachable seat system. In yet another example, detachable tether can be connected around the circumference of floatation device 100.

As also shown throughout the figures, floatation device 100 can be composed of a transparent material. As such, in using floatation device 100 composed of the transparent material where outer air chamber 110 and inner air chamber 120 are independently inflated via their respective air valves, where the neck of the wearer (e.g., an infant) is placed within the central opening, and where the wearer wearing the floatation device is placed in a body of water, objects of potential interest (e.g., floating toys) that are positioned near and in front of the wearer can be unobstructed from the view of the wearer. In another example, a caregiver or therapist accompanying the wearer in the body of water can also be provided with an unobstructed view of, among other things, the movements of the wearer (e.g., the body position of the wearer of floatation device 100). In yet another example, a wearer of floatation device 100 can be assisted by a therapist, where such aquatic or physical therapy can leverage the buoyancy of water to help overcome gravitational constraints, such as the constraints gravity imposes on control of movement for infants who are not ambulant on land or who have a limited range of mobility due to muscular or neuromuscular disabilities or temporary developmental delays.

Accordingly, a floatation device is provided.

Although the invention has been described and illustrated in the foregoing illustrative embodiments, it is understood that the present disclosure has been made only by way of example, and that numerous changes in the details of implementation of the invention can be made without departing from the spirit and scope of the invention. Features of the disclosed embodiments can be combined and rearranged in various ways.

What is claimed is:

1. A floatation device for a wearer, comprising:

an inflatable ring composed of a transparent material that has a top surface, a bottom surface, and an interior space, wherein the inflatable ring includes:

a toroid-shaped outer air chamber;

a toroid-shaped inner air chamber, wherein the toroid-shaped outer air chamber and the toroid-shaped inner air chamber are inflated using a single air valve and wherein the toroid-shaped inner air chamber is formed such that an outer edge of the toroid-shaped inner air chamber is connected to an inner edge of the toroid-shaped outer air chamber;

a cut through the toroid-shaped outer air chamber and the toroid-shaped inner air chamber of the inflatable ring that forms opposing ends of the inflatable ring; and a plurality of fasteners placed on a top surface and a bottom surface of the toroid-shaped outer air chamber for detachably connecting the opposing ends of the inflatable ring.

2. A floatation device, comprising:

an inflatable ring composed of a transparent material, wherein the inflatable ring includes:

an outer air chamber;

an inner air chamber, wherein the outer air chamber and the inner air chamber are inflated using a single air valve;

a cut through the outer air chamber and the inner air chamber of the inflatable ring that forms opposing ends of the inflatable ring; and a plurality of fasteners placed on a top surface and a bottom surface of the outer air chamber for detachably connecting the opposing ends of the inflatable ring.

3. The floatation device of claim 2, wherein the single air valve is formed on the top surface of the outer air chamber.

4. The floatation device of claim 2, wherein the single air valve is formed on the bottom surface of the outer air chamber.

5. The floatation device of claim 2, wherein the single air valve is formed on the top surface of the inner air chamber.

6. The floatation device of claim 2, wherein the single air valve is formed on the bottom surface of the inner air chamber.

7. The floatation device of claim 2, wherein, upon inflating the outer air chamber and the inner air chamber via the single air valve and connecting the plurality of fasteners to connect the end and the opposing end of the inflatable ring, the inflatable ring is substantially toroid-shaped.

8. The floatation device of claim 2, further comprising a recess for a chin rest that is formed in the inner air chamber.

9. A method for providing a floatation device for an infant, the method comprising:

providing an inflatable ring composed of a transparent material, wherein the inflatable ring includes:

an outer air chamber;

an inner air chamber, wherein the outer air chamber and the inner air chamber are inflated using a single air valve;

a cut through the outer air chamber and the inner air chamber of the inflatable ring that forms opposing ends of the inflatable ring; and a plurality of fasteners placed on a top surface and a bottom surface of the outer air chamber for detachably connecting the opposing ends of the inflatable ring; and inflating the outer air chamber and the inner air chamber via the single air valve.

10. The method of claim 9, further comprising placing a neck of the infant into an interior space formed in a center region of the inflatable ring in which the outer air chamber and the inner chamber have been inflated.

11. The method of claim 9, further comprising placing an object of interest proximal to the infant wearing the inflatable ring, wherein the transparent material of the inflatable ring allows the object of interest to be visible in a line of sight of the infant.

12. The method of claim 9, further comprising attaching the plurality of fasteners to connect the opposing ends of the inflatable ring.

13. The method of claim 9, further comprising placing a chin of the infant onto a recess that is formed on the inner air chamber.

* * * * *